United States Patent [19]

Smith

[11] Patent Number: 4,802,143

[45] Date of Patent: Jan. 31, 1989

[54] ALARM SYSTEM FOR MEASUREMENT WHILE DRILLING OIL WELLS

[76] Inventor: Robert D. Smith, P.O. Box 219, Plum Branch, S.C. 29845

[21] Appl. No.: 852,792

[22] Filed: Apr. 16, 1986

[51] Int. Cl.[4] ..... H04H 9/00

[52] U.S. Cl. ..... 367/82; 367/86; 73/151; 73/155; 175/40; 324/325

[58] Field of Search ..... 175/24, 40, 50, 59; 367/81, 82, 83, 86, 25, 35, 911, 912; 73/151, 153, 155; 340/853, 386; 181/103; 250/254; 324/324, 325

[56] References Cited

U.S. PATENT DOCUMENTS

| | | | |
|---|---|---|---|
| 2,677,790 | 5/1954 | Arps | 324/323 |
| 2,755,432 | 7/1956 | Arps et al. | 324/369 |
| 3,673,864 | 7/1972 | Cubberly | 73/153 |
| 3,813,656 | 5/1974 | Fowler | 367/82 |
| 3,845,837 | 11/1974 | McEvers, Jr.; et al. | 181/106 |
| 3,860,902 | 1/1975 | Galle | 367/83 |
| 4,021,773 | 5/1977 | Keenan | 367/82 |
| 4,027,282 | 5/1977 | Jeter | 367/85 |
| 4,066,994 | 1/1978 | Patchett et al. | 175/50 |
| 4,235,021 | 11/1980 | Claycomb | 33/307 |
| 4,254,481 | 5/1981 | Smither et al. | 367/82 |
| 4,276,943 | 7/1981 | Holmes | 175/40 |
| 4,282,588 | 8/1981 | Chanson et al. | 367/82 |
| 4,291,395 | 9/1981 | Holmes | 367/83 |
| 4,293,937 | 10/1981 | Sharp et al. | 367/82 |
| 4,298,430 | 11/1981 | Rolstad et al. | 367/247 |
| 4,298,970 | 11/1981 | Shawhan et al. | 367/82 |
| 4,302,826 | 11/1981 | Kent et al. | 367/82 |

(List continued on next page.)

OTHER PUBLICATIONS

Publication Entitled "Mud Pulse MWD (Measurement-While Drilling) Systems Report"—SPE 10053, by Gearhart et al, Society of Petroleum Engineers of AIME.

Publication Entitled "Mud Pulse Logging While Drilling Telemetry System Design, Development, and Demonstrations"—by R. R. Spinnler et al, Teleco Oilfield Services, Inc., Middletown, Conn., Presented at 1978 Drilling Technology Conference of the International Association of Drilling Contractors Mar. 7-9, 1978, Houston, Tex.

Publication Entitled "The Fluidic Approach to Mud Pulser Valve Design for Measurement-While Drilling Applications"—by A. B. Holmes, U.S. Army Laboratory Command, Harry Diamond Laboratories, Adelphi, Md. (Report No. HDL-TR-2058).

*Primary Examiner*—Charles T. Jordan
*Assistant Examiner*—John W Eldred
*Attorney, Agent, or Firm*—Holman & Stern

[57] ABSTRACT

A detector for use in wells comprises a collar member connected to a drill string at a position down-well with respect to the surface of the earth, a sensor in the collar in the area being monitored for sensing down-well fluids in deep wells, an impulse generator cavity in the collar, an acoustic impulse generator mounted in the impulse generator cavity for producing a deformation wave in the drill string, having longitudinal, torsional and radial components, an elongated fluid sampling cavity in the collar having lower and upper ends and inlet and outlet means, respectively, in the lower and upper ends for allowing the passage of down-well fluids through the sampling cavity, such fluids being primarily mixtures of mud and oil and mixtures of mud, oil and gas. The sensor is supported within the sampling cavity in a position so that when gas enters into the cavity in abnormal amounts, separation of the components of the mixture produces variations in thermal conductivity properties sensed by the sensor. The sensor is operatively connected to the impulse generator to actuate the generator when a predetermined threshold concentration of undesirable fluid is exceeded in the sampling cavity, whereby the impulse generator produces a deformation wave which is conducted in the drill string to a detector remote from the impulse generator and which in turn is connected to a pulse alarm analyzer which indicates the condition in the well.

45 Claims, 16 Drawing Sheets

U.S. PATENT DOCUMENTS

| | | | |
|---|---|---|---|
| 4,313,792 | 2/1982 | Smith | 376/247 |
| 4,320,473 | 3/1982 | Smither et al. | 367/82 |
| 4,323,991 | 4/1982 | Holmes et al. | 367/83 |
| 4,356,061 | 10/1982 | Smith et al. | 376/254 |
| 4,370,886 | 2/1983 | Smith et al. | 175/40 |
| 4,373,375 | 2/1983 | Terhune et al. | 73/19 |
| 4,387,372 | 6/1983 | Smith et al. | 340/854 |
| 4,390,975 | 7/1983 | Shawhan | 367/82 |
| 4,391,299 | 7/1983 | Holmes | 137/831 |
| 4,399,877 | 8/1983 | Jackson et al. | 175/45 |
| 4,401,134 | 8/1983 | Dailey | 137/624.11 |
| 4,411,858 | 10/1983 | Smith | 376/247 |
| 4,418,035 | 11/1983 | Smith | 376/247 |
| 4,418,721 | 12/1983 | Holmes | 137/810 |
| 4,425,297 | 1/1984 | Rolstad et al. | 376/247 |
| 4,439,396 | 3/1984 | Rolstad | 376/247 |
| 4,440,716 | 4/1984 | Smith | 376/247 |
| 4,445,734 | 5/1984 | Cunningham | 439/194 |
| 4,459,045 | 7/1984 | Smith | 374/132 |
| 4,468,665 | 8/1984 | Thawley et al. | 340/856 |
| 4,474,250 | 10/1984 | Dardick | 175/1 |
| 4,506,263 | 3/1985 | Sidhwa | 340/856 |
| 4,527,425 | 7/1985 | Stockton | 73/155 |
| 4,567,013 | 1/1986 | Smith | 376/247 |
| 4,569,412 | 2/1986 | Bouyoucos et al. | 367/911 |
| 4,573,532 | 3/1986 | Blake | 73/153 |
| 4,575,260 | 3/1986 | Young | 73/154 |

FIG. 1
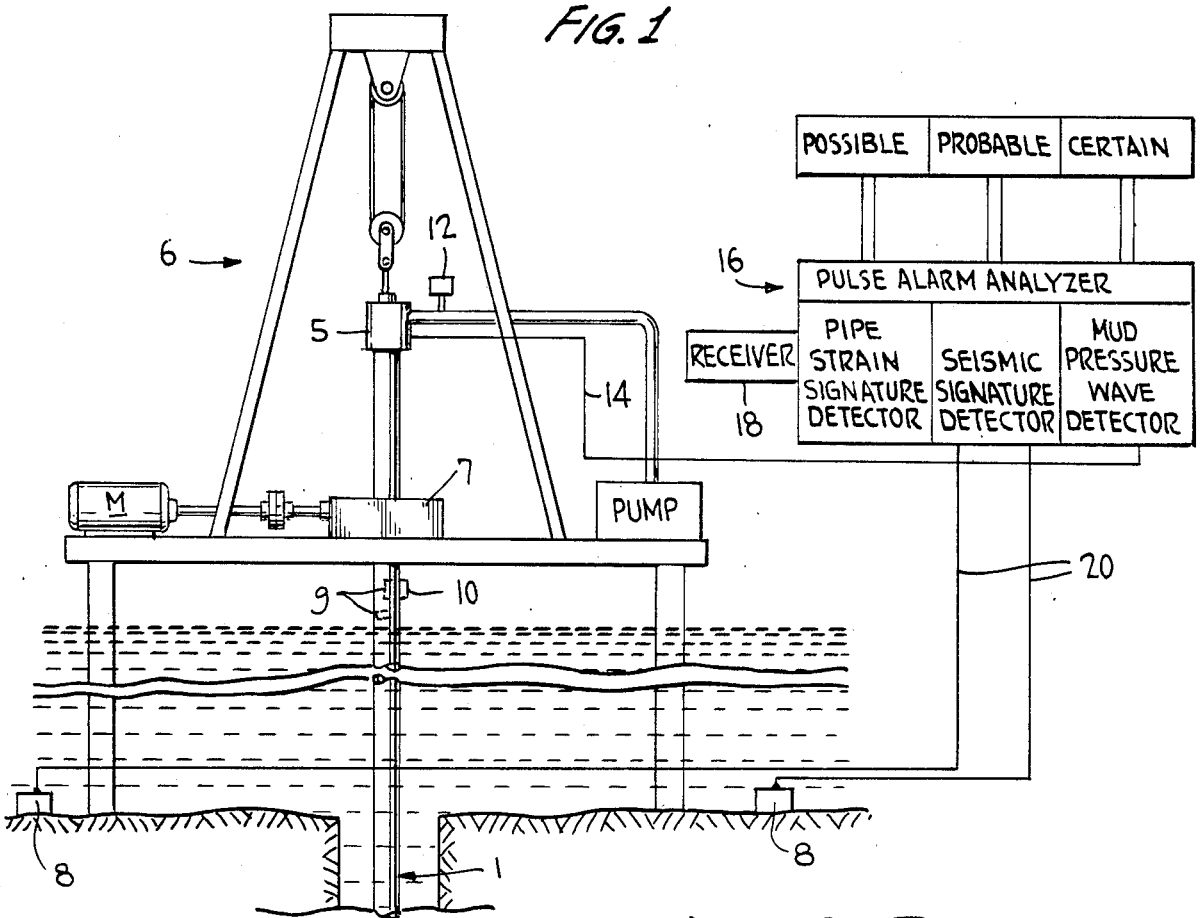
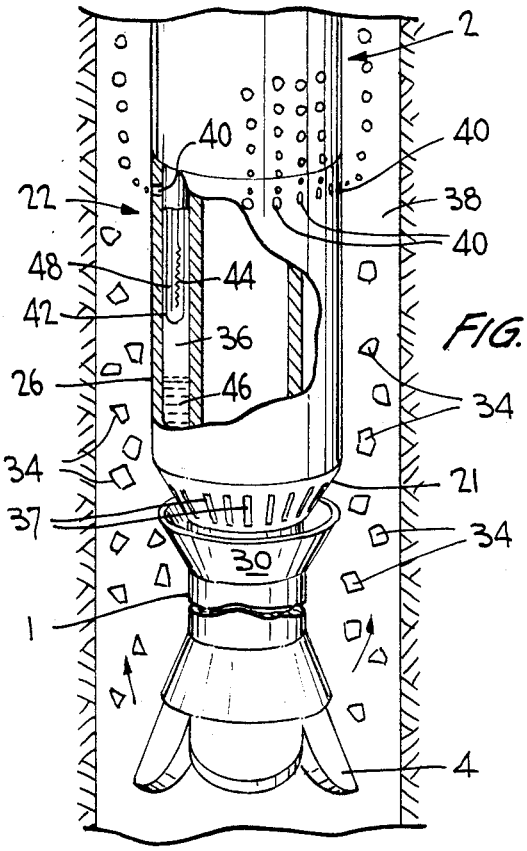
FIG. 4

ALARM SYSTEM FOR MEASUREMENT WHILE DRILLING OIL WELLS

BACKGROUND OF THE INVENTION

1. Field of the Invention

This invention relates to oil well drilling and more particularly to sensor, telemetry and discrimination systems for detecting and indicating the presence downwell of particularly hazardous conditions and producing early warning to surface drill rig operators of the existence of such conditions.

2. Description of the Prior Art

For purposes of economics and safety during the drilling of oil wells, attempts, dating at least as far back as 1932, to make various measurements down well while drilling was taking place, have been made. The major obstacle to actual utilization of systems for this purpose has been the problem of transmitting values of parameters being measured deep in the earth, near the drill bits, back up to the drillers who could make strategic use of them to control the process.

In the 1960's and 1970's with the itensified need for "slant" or deviation drilling from a single central offshore platform, and the increasing awkwardness and cost in such wells of the frequent removal (tripping) of the drill string to permit measurement of various guiding parameters by lowering "wire-line" logs and sondes, measurement while drilling [MWD] was given new impetus which finally succeeded in launching the industrial development necessary to reduce this concept to actual large scale practice.

The first and seemingly logical attempts to transmit measured values up the steel drill pipes in the form of acoustical waves in the steel were doubly frustrated in that demands of the period were not only for increasing amounts of information (not only the original parameters such as compass heading of bore and angle from vertical but many new parameters as well), but also that more and more transmission horsepower was being required to overcome unexpectedly high sonic signal attenuation due to viscous damping by drilling mud and losses due to discontinuities in the drill string dimensions at collars and at threaded joints (joints occur at about 30 ft. intervals up drill strings that can be 15,000 to 20,000

The attempts to increase transmission signal horsepower and information density (number of parameters) resulted in abandonment of electric batteries as power sources by most aspiring MWD service firms, and the introduction of mud-flow driven turbine-generators down well to supply more power to transmission systems. At about the same time, several of the original developers gave up entirely on drill-string acoustical telemetry attempts and converted their (now mud-driven) power supply systems to the production of mud pressure signal pulses that travel at speeds of about 4000 ft/sec up the supply mud column which flows down through the center of the drill pipe. The early history of sonic and mud pulse system development is well related in the paper entitled "MUD PULSE LOGGING WHILE DRILLING TELEMETRY SYSTEM DESIGN, DEVELOPMENT, AND DEMONSTRATIONS", by R. F. Spinnler and F. A. Stone, presented at the 1978 Drilling Technology Conference of the International Association of Drilling Contractors Mar. 7–9, 1978, Houston, Tex. in which the authors relate their decision to convert from sonic to mud pulse telemetry regardless of limited data density in mud pulse systems, having been defeated by the high energy requirements (to overcome attenuation) in drill string source telemetry systems even though, conceptually, more data per second could have been transmitted via the steel pipe of the drill string.

Another paper entitled "MUD PULSE MWD (MEASUREMENT-WHILE-DRILLING) SYSTEMS REPORT", by M. Gearhart, A. Ziemer, and O. Knight, presented at the 56th Annual Fall Technical Conference and Exhibition of the of the Society of Petroleum Engineers of AIME, San Antonio, Tex., Oct. 5–7, 1981 describes state-of-the-art methods of mud pulse telemetry at that time including negative mud-pulse telemetry and positive and oscillating pressure pulses in the drill mud columns. At that time transmitting and receiving, just the six parameters that give complete drill direction data, took from 1½ to 3 minutes of mud pressure pulsing by any of the operating mud pulse telemetry (MPT) systems.

A number of U.S. Pat. Nos. e.g., 4,302,826; 4,282,588; 4,390,975; 4,254,481; 4,298,970; 4,293,937; and 4,320,473 show continuation of the struggle to generate and maintain signals (deformation waves) in the steel drill pipes to utilize the conceptually advantageous, but apparently unattainable, advantages of the steel telemetry systems.

From the late 1970's to the present time the majority of development effort has concentrated on extending the range of parameters measured and transmitted from downwell during drilling from the original azimuth and angle measurements to include lithographic measurements such as formation gamma ray activity and resistivity and, later, a series of drilling parameter measurements such as weight and torque on bit, annular mud pressure and temperature and other bits of information, aimed at improving the economy of drilling and reducing frequency of expensive wire line logging which also interrupts costly drilling operations. All of this information availability has placed additional demand on the already limited data transmitting capability of mud pulse telemetry systems.

The U.S. Department of Interior sponsored, in an effort to improve offshore well safety, development work on faster mud pulse telemetry, based on the principles of fluidic amplifiers the results of which are reflected in the following U.S. Pat. Nos. 4,276,943; 4,291,395; 4,323,991; 4,391,299; and 4,418,721. The family of devices represented may represent the ultimate in rate of transmittal of information by MPT, having been tested at data rates up to 40 binary "bits" per second which (at 12 bits per data "word") is 40 to 80 times "faster" than mud pulse telemetry systems in current commercial use.

In their quest for information density in MWD, the telemetry developers have inadvertently neglected one of the vital potential roles for measurement while drilling, namely, the safety role of early notification to the drilling operator that an unsafe condition is occurring downwell.

The primary cause of drilling disasters is blow out which is preceeded by the phenomenon identified in the trade as a "kick" in which gas (or supersaturated hydrocarbon liquid) enters the mud filled drilling annulus unexpectedly and, in moving toward the upper (lower pressure) regions of the drill hole, expands and accelerates the displacement of mud from the annulus, leading, in the ultimate disaster, to uncontrolled burning of formation fluids and gases within the structure of the drilling rig. Only in about 1 well in 500 does such a blowout occur, while a less serious "kick" that allows formation fluids to emerge from the annulus (and is controlled by means at hand) occurs once in four or five wells. A properly controlled drilling operation maintains mud pressure against the formation fluids throughout the drilling process and the gases and oils entering the mud are limited to those being liberated at the time by the bit from the rocks or formations currently being drilled.

When, on occasion, the formation pressures have been underestimated in control of drilling mud overpressure, or where pockets of gas or oil at unpredictedly high pressures are penetrated, formation fluids intrude into the drill annulus and an incipient "kick" condition exists. Such intrusions of formation fluids (which can be gas, gas saturated oils, or stable liquid hydrocarbons), are usually detected by mud flow and inventory instruments upwell and controlled by various techniques available to the driller, one of which is increasing mud density. Perhaps only one in twenty unexpected formation fluid intrusions actually develops in to a "kick", which is subsequently controlled by various means such as mud density change or even blow out preventers. Approximately one kick in one hundred develops into an uncontrolled blow out such as occurred in the Norwegian offshore fields on Oct. 6, 1985.

The unfortunate state-of-circumstances, in view of MWD development to date, is that 75% of such unplanned well fluid intrusions, with their associated small potential for disaster, occur at phases of the drilling cycle when all forms of mud pulse telemetry are inoperative because mud is not circulating. These phases of the cycle are conditions known, for example, as "tripping", when drill pipe is being removed for logging, "swabbing", when the suction of drill pipe being raised lowers mud pressures below the bit, and "hang off" when the drill pipe is left in the well (offshore) and the rig is moved away due to high seas, for example.

Thus, even if sensors had existed to reliably detect unexpected gas intrusion into the well, the chosen mud pulse (MPT) telemetry systems would not serve to alert the operator at an early stage of that occurrence in 75% of such potentially dangerous well fluid intrusions. Perhaps this unsuitability of MPT, the only practical telemetry to date, has implicitly discouraged effort directed specifically to the search for unambiguous detectors of the "kick alarm" condition itself, deep down well. "Alarm telemetry" does not yet exist because the high data density goals of "Information Telemetry", toward which developers have been striving, in themselves defeat the contrary criteria (not heretofore articulated) for "Alarm Telemetry" functions.

Information telemetry demands the nearly continuous flow of large numbers of data "bits" as rapidly as possible, and in so doing, has demanded that means be devised to supply growing amounts of energy on a more-or-less continuous basis.

In contrast, an alarm condition may occur as infrequently as once in two weeks or once in a month of drilling operations. Hence alarm telemetry requirements are not for streams of data "bits", to be detected and interpreted upwell, but rather for a transmitter-receiver system capable of unambiguously handling as few as four to six "bits" of transmitted data over a two month period. With such extremely low data density requirements defined and recognized, in contrast to high data density goals of information telemetry systems, such as 40 "bits" per second, entirely different boundary conditions exist that have enabled the inventor to fulfill the functional requirements of alarm telemetry. For example, it is possible to devote enormous energy to a single pulse, assuming the reliable transmission of a single "bit" of data indicating the binary statement "YES (an alarm condition does now exist)", whereas the continual expenditure of such energy on a stream of bits, as required for information telemetry, would require horsepower (or killowatt-hour) capacities beyond the reach of any mud turbogenerator or battery system conceivable for use downwell, and would exhaust single-use explosive cartridges at such rates as to render that means of energy delivery completely impracticable.

BRIEF SUMMARY OF THE INVENTION

It is the object of the invention to, for the first time, distinguish two separate categorical functions of measurement while drilling: "Information MWD and telemety"; and "Alarm Condition MWD and Telemetry", applying, to the latter, such criteria as "diversity", "redundancy", and "alarm condition logic" developed and applied heretofore in the nuclear and aerospace industries, and to define several embodiments of "kick" alarm systems made feasible by the combination of the thermally activated sensors and the large amounts of energy that can be allocated and expended for the rare, but important communication of the existence of an alarm condition.

It is a further object of this invention to provide a separate and independent Alarm Condition monitoring system energy for measurement-while-drilling oil wells consisting of excess hydrocarbon detector(s) and high impulse transmitter in a drill pipe collar downwell, and several diverse detectors at surface level sending to an alarm condition analyzer also at the surface.

It is another object of this invention to define thermally activated detectors so arranged as to sense and signal, unambiguously, the occurrence of unexpected levels of hydrocarbon in the annular drill mud stream returning up well from the drill bit.

It is a further object of this invention to use said alarm condition detector signal to activate a unique powerfull telemetry pulse signal which imparts so much energy to the steel drill pipe, (which from there is transmitted through the walls of the drill pipe to surrounding mud and formation) that the single alarm telemetry pulse survives, detectably the large damping and attenuation, and imparts through the loss paths of the deformation wave travelling up the steel drill string, sufficient energy to surrounding drill mud and geologic formation so as to produce coincident, but slower travelling pressure and seismic waves unambiguously detectable with pressure transducers in mud column, and geophones or microphones "listening" to the formation.

It is a still further object of this invention to sound an upwell "unsafe condition" alarm when the signal characteristic of one or more of such waves arrives in alarm signature sequence at the Alarm pulse analyzer, said analyzer being gated and filtered to acknowledge only said combinations as "true" alarm conditions rejecting combinations of signals outside the acceptable signature band as false, noise-produced, alarm indications.

It is another object of the invention to provide a telemetry means that is active and prepared to transmit at all phases of the drilling operation, during which the drill pipe is down well, whether rotating or not, whether mud is circulating or not, and whether the drill string is being raised or lowered in the bore hole.

It is another object of the invention to provide such a detection-telemetry-alarm system whose continual demand for electric power is so low as to be supplied, for periods exceeding two months of monitoring, solely by conventional batteries in the drill pipe collar, dedicated to the alarm condition monitoring system, thereby avoiding need for trouble-prone turbine generators and mud valves required for continuously power demanding information telemetry systems.

This invention employs, when desired, armatures or projectiles which impart an initial alarm condition impulse to the specially designed steel drill string collar interior to produce a characteristic multiple impact or wave form "signature" in the drill string (a wave which shape in itself is unique) giving high probability that the isolated drill string sonic signal, scrutinized and passed by the alarm pulse analyzer into the alarm system, is not a false alarm. Alternatively, such characteristic wave form is to be achieved by imparting both torsional and longitudinal impulse components to downwell drill pipe deformation by causing a projectile or armature to impact at an angle to the axis of the drill string.

It is another object of the invention to apply such down-hole logic to the telemeter (detonation) pulse triggering device as to render false triggering of the alarm pulse transmission highly unlikely. In simplest forms two or more, similar or diverse, hydrocarbon detectors are arranged at different positions on the alarm collar so as to require positive signals (closed switch) from both to trigger the telemeter pulse.

The invention employs telemetry means that apply the very high forces of projectile impact and decelleration to produce longitudinal or torsional (or both) strain pulses in the steel drill pipe for very short durations of time and to exploit the rarity of occurrence of the need for such signal pulses to assure that time-averaged power consumption is very low, thus rendering practicable the reloading or recocking of the multi-shot impulse-producing devices at convenient periods when the drill pipe and bit have been withdrawn from the well for other reasons. Any pulse producing device within the scope of the invention must accelerate a mass through a relatively large distance, and relatively long time, to secure large momentum of the mass at relatively low levels of applied acceleration force, and all devices falling within the scope of the invention must thereupon suddenly decellerate the high velocity mass within a very short time and distance to impart high impulse force to a target, or anvil, solidly affixed to the interior of a drill collar cavity. Hardened highly elastic materials are preferred for the armature (or projectile) and for the anvil or target. If highly elastic impact with efficient energy recovery "bounce-back" of the projectile is induced, the force transmitted to the anvil by the armature or projectile may be doubled for the same energy expended in accelerating said projectile. Materials such as Hasteloy or Stellite may be employed for either projectile or anvil surfaces to increase the elastic efficiency of impacts.

In the classic "gun and target" mechanics described, three types of "guns" are suitable for armature or projectile acceleration: electromagnetic gun; compressed gas gun; and detonation (bullet) gun. In the preferred embodiment discussed, a multi-barrelled detonation gun employing single use explosive cartridges is employed for the impulse-producing transmitter of the Alarm system.

The triggering system logic circuits are arranged so that, as later-and-separate alarm condition events occur, in the course of the months long drilling cycle, the triggering alarm condition signal fires the multiple shot impulse generators in a predetermined sequence, and blocking logic circuits are arranged to prevent triggering more than a single alarm telemetry pulse on a single excess hydrocarbon alarm condition downwell. Means for firing, stepping and resetting such circuits are described in U.S. Pat. No. 2,759,143, for example.

BRIEF DESCRIPTION OF THE DRAWINGS

The invention will now be described in detail with reference to the accompanying drawings, wherein:

FIG. 1 is a schematic illustration of the entire alarm detection/telemetry transmitter-receiver and heirarchial annunciator in accordance with the invention;

FIG. 4 is a perspective cut-away and part cross-sectional schematic view of the lower part of FIG. 2 and showing the lower end of the alarm condition collar designated as "Gas Catcher sub" (subassembly) which catches gas coming into the annulus, and using a Radcal Heat Transfer Monitor (RHTM) produces an alarm signal to the telemetry system, when a quantity of gas justifies this alarm condition notification.

Figure 6:
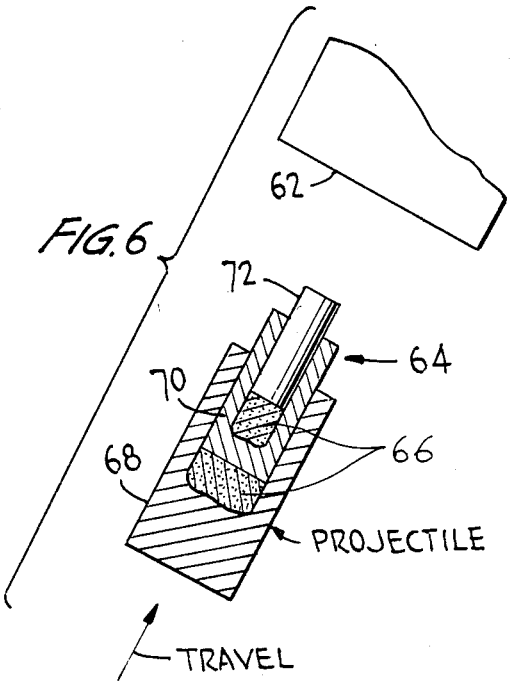
FIG. 6 is a cross-sectional view showing an embodiment of the invention utilizing a composite projectile designed to produce a characteristic impulse wave form as it impacts the target and corresponding longitudinal and torsional strain patterns received by upwell strain gages.
Figure 7A:
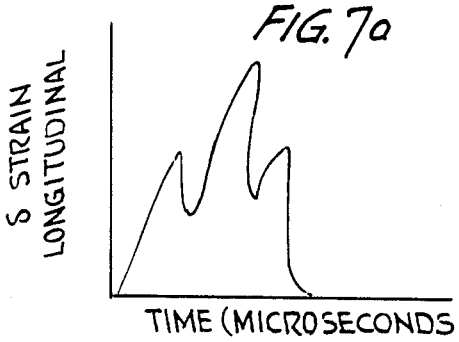
Figure 7B:
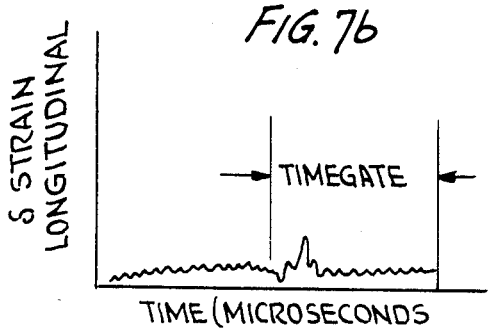
Figure 7C:
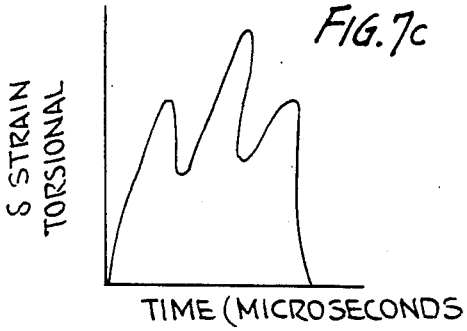
Figure 7D:
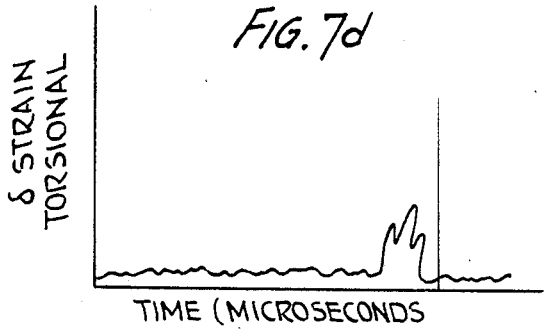
Figure 8:
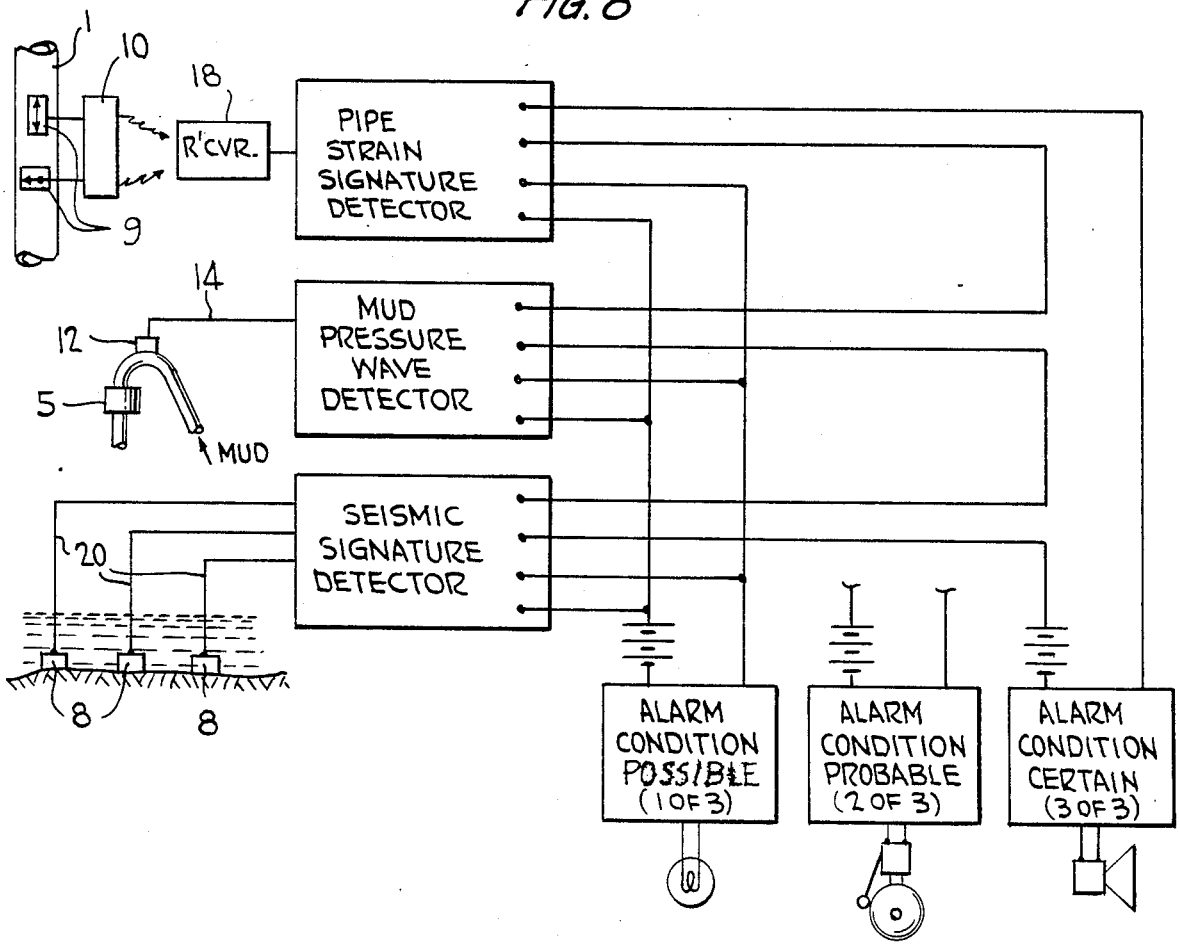
Figure 9:
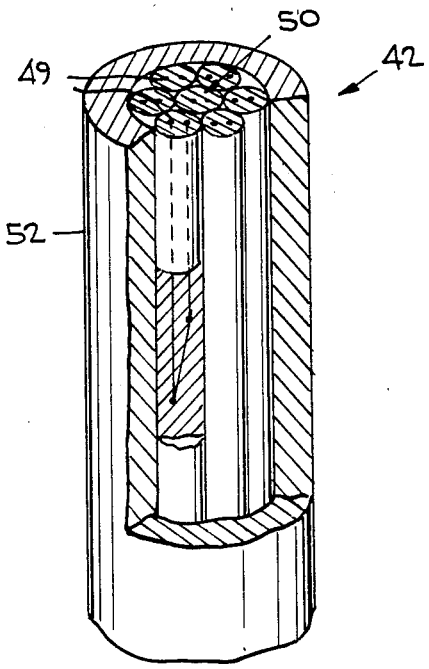
Figure 10:
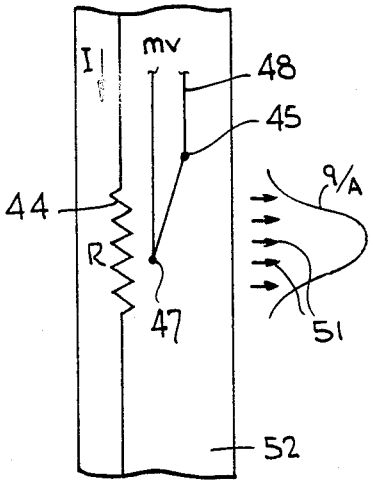
Figure 11:
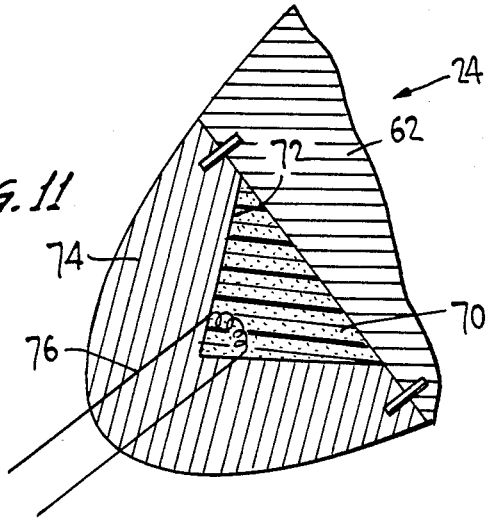
Figure 11A:
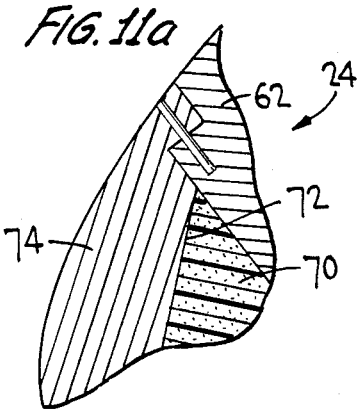
Figure 12:
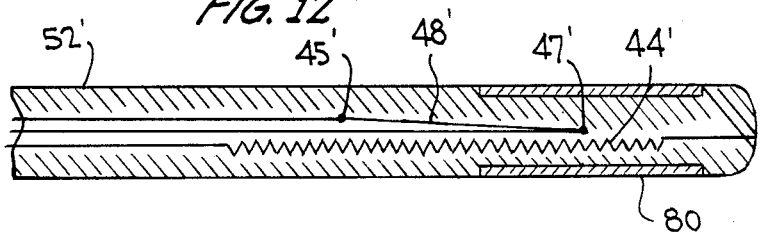

FIGS. *7a* through *7d* are diagrams showing characteristic impulse wave forms produced by the composite projectile shown in FIG. 6 and the corresponding longitudinal and torsional strain patterns received by upwell strain gages;

FIG. 8 is a schematic circuit diagram showing an alarm system in accordance with the invention;

FIG. 9 is a perspective view of a "Radcal" Heat Transfer Monitor", RHTM, as used in the invention;

FIG. 10 is a sketch showing the operation of the RHTM shown in FIG. 9;

FIG. 11 and FIG. 11A are schematic cross-sectional views of a shaped charge embodiment for producing a deformation wave; and FIG. 12 is a cross-sectional view of a further embodiment of the invention using a catalytically enhanced oxidation sensor.

DETAILED DESCRIPTION

Refering to FIG. 1 there is shown a general examplary arrangement of a drill string 1, containing hydrocarbon, or gas, detectors within an alarm condition collar 2 mounted on the drill string downwell beneath the surface of the earth in well hole 3, which collar also contains multi-shot alarm condition impulse transmitters, as will be described in detail below. This collar serves as a housing for parts of the telemetry system and is larger in diameter than the drill pipe of the drill string itself and smaller than the bit 4 shown at the lower end of the drill string. The collar 2 may be from 15 to 60 ft in overall length, and is located low in the well, but not necessarily directly above the drill bit 4. In the embodiment illustrated, a single such alarm condition collar is installed. Two or more such collars could be installed along the drill string without impairing the function of the alarm system, and extending the length of the kick protection zone.

The drill string 1 is supported and suspended in the embodiment shown from a swivel unit 5 mounted in a well-known manner on an offshore oil well structure, or drilling platform of a conventional and well-known type generally indicated at 6 including a conventional rotary table 7.

FIG. 1 also shows components of the alarm MWD system located on the seafloor and drilling platform including: one or more geophones 8 to detect seismic pulses arising from a "shot" of the impulse telemetry transmitter; a strain gauge/radio transmitter 10 (or accelerometer/transmitter) on the upper pipe below the rotary table 7 and revolving with the pipe for detecting and transmitting longitudinal or torsional pipe strain, or both; and a pressure transducer 12 located in the swivel 5 supplying mud to the interior of the rotating drill pipe. These components are linked by electrical conducting wire 14 or radio-transmitter receivers to the schematically illustrated Pulse Alarm Analyzer 16.

As depicted in FIGS. 1 and 8 the pipe strain gage sensors 9 are linked by a radio transmitter-receiver 10,18 to the Pipe Strain Signature Detector of the Pulse Alarm Analyzer 16, the amplified geophone 8 signals are linked by cables 20 or radio transmitter (not shown) to the Seismic Signature Detector of the analyzer, and the pressure transducer 12 is linked by electric conducting cable 14 (for example) to the Mud pressure Signature Detector of the Analyzer unit 16.

Analog or digital functions within the Pulse Alarm Analyzer 16 are arranged to close alarm producing switches only when characteristic pulse signatures are recognized, usually arriving in the following sequence determined by the speed of the pulse signal being monitored: (1) drill pipe; (2) mud pressure; (3) seismic. The respective components on the Pulse Alarm Analyzer are: Pipe Strain Signature Detector; Mud Pressure Wave Detector; Seismic Signature Detector.

A hierarchy of alarms is shown in FIGS. 1 and 8 as Condition "possible", Condition "probable", Condition "certain". The logic structure for activation of such alarms is settable by the user and could, for example, be as illustrated in FIGS. 1 and 8: "Possible" when any one pulse signature has been detected; "Probable" when any two of three pulse signatures have been detected; "Certain" when all three pulse signatures have been detected.

In the complete alarm telemetry system any single detector of alarm condition, for example, "excess hydrocarbon in annulus", "low annulus pressure", "gas in annulus", or other such sensors, if requiring electric power, are supplied by long-lived batteries 11 situated within the self-contained alarm collar 2 and have generally low level of power requirements. The production of single alarm impulse signals, on the other hand, requires very large amounts of energy when on rare occasion, it becomes necessary to produce such alarm impulses. Such energy is supplied not by the batteries, but, by electrically fired explosive charges, or in the preferred embodiment of the invention, an impulse is transferred from an inertial mass or projectile accelerated by an explosive charge to the drill pipe interior. The initial strains of the drill pipe are propogated in the form of acoustic waves through the drill string. Energy transferred from the steel drill string walls to the drill mud (when the bore is mud filled), and from the mud to the formation (surrounding geological structure in which the well hole is being made), produces secondary pressure waves in the mud and in the formation, which are of characteristic form, and usually distinguishable from background mud pressure and seismic waves.

The impulse can also be produced by an electromagnetically accelerated inertial mass or projectile utilizing an armature or series of armatures in place of the explosive charge device, or devices. The impulse could also be produced by a compressed gas fired inertial mass, or projectile by utilizing a compressed gas gun, or guns, in place of the explosive charge device or devices. One might also use a shaped charge such as shown in FIG. 11 wherein, an explosive charge is contained within a chamber, e.g., having a conical shape on the inner surface of a steel body 74 for focusing the explosive force of the charge 72 onto the anvil to produce the maximum deformation wave possible from the charge. The body 74 can be fastened to the anvil by any conventional device such as screws, or bolt and nut arrangements. The body 74 may also be a magnetic body which is magnetically attachable to the anvil 62. The shaped charge is electrically ignited by firing device 76 connected to triggering device 56 and produces an impact on the anvil 62 which generates a deformation wave having the same detectable vectors as described in the embodiment using the gun and projectile.

Figure 2:
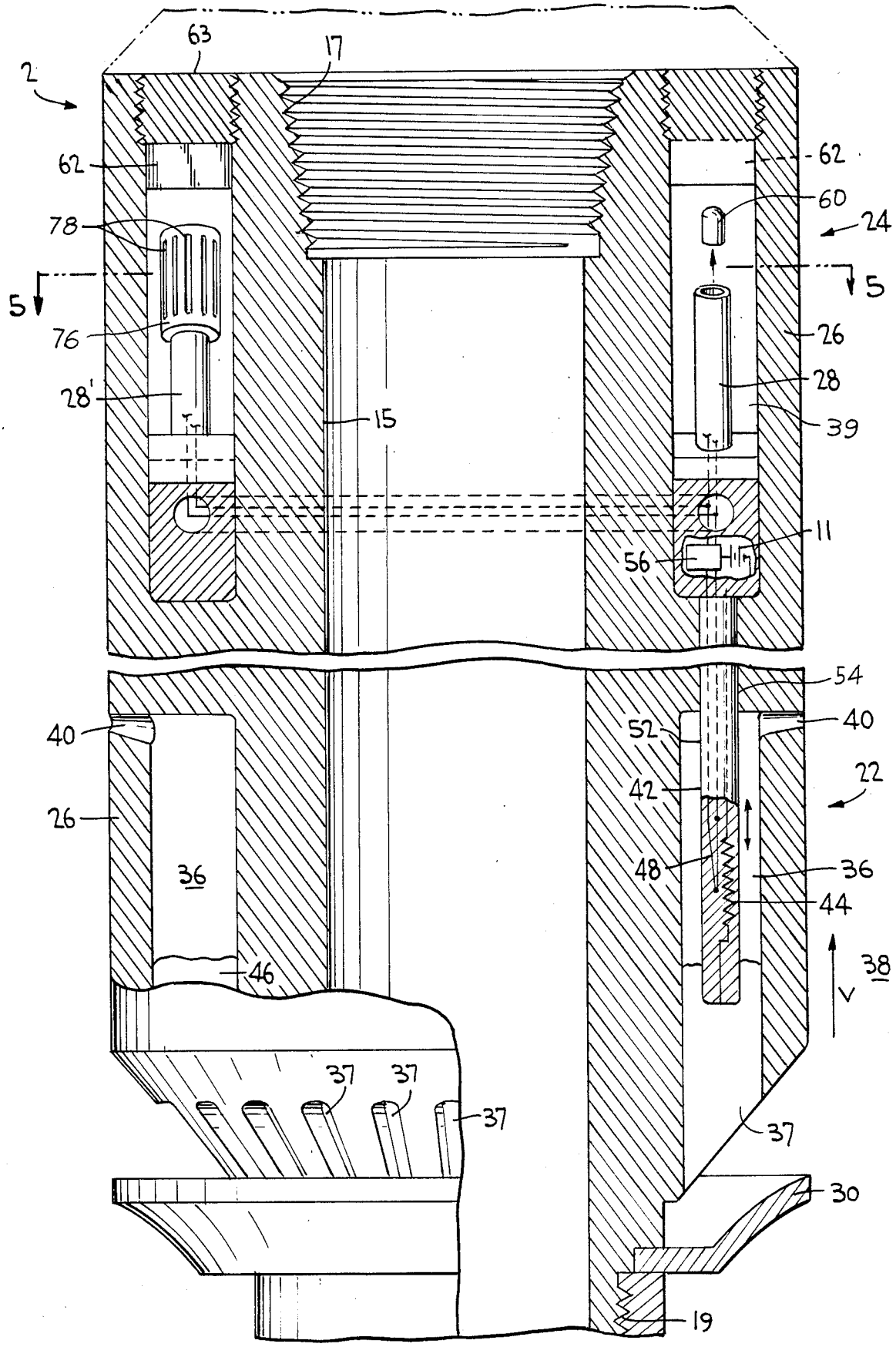
FIG. 2 is a cross-sectional/exploded view showing the interior cavities of the detector/transmitter collar.
Figure 3:
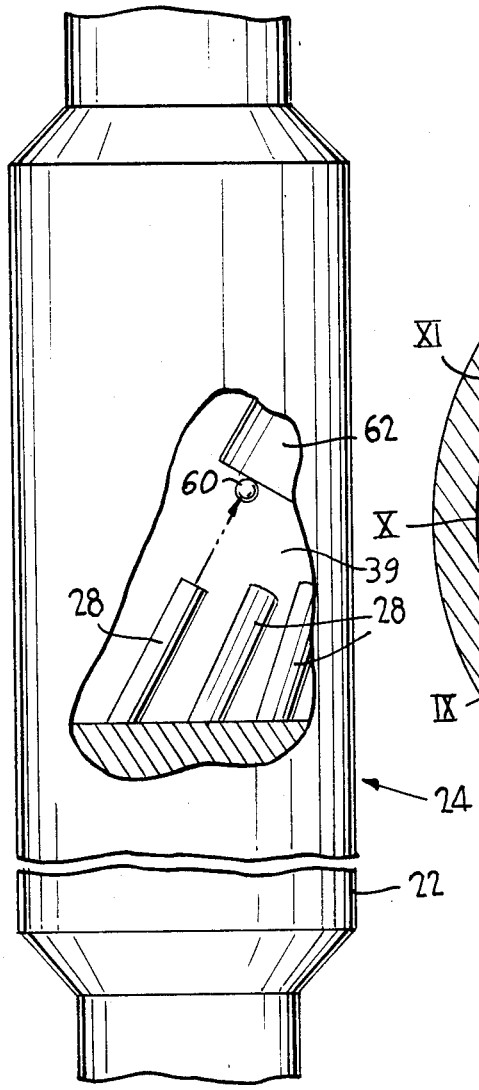
FIG. 3 is a cut-away view of the upper part of FIG. 2 showing the arrangement of a single alarm gun so that the deceleration of its projectile by the target (anvil) imparts both torsional and longitudinal strain to the drill pipe.
Figure 5:
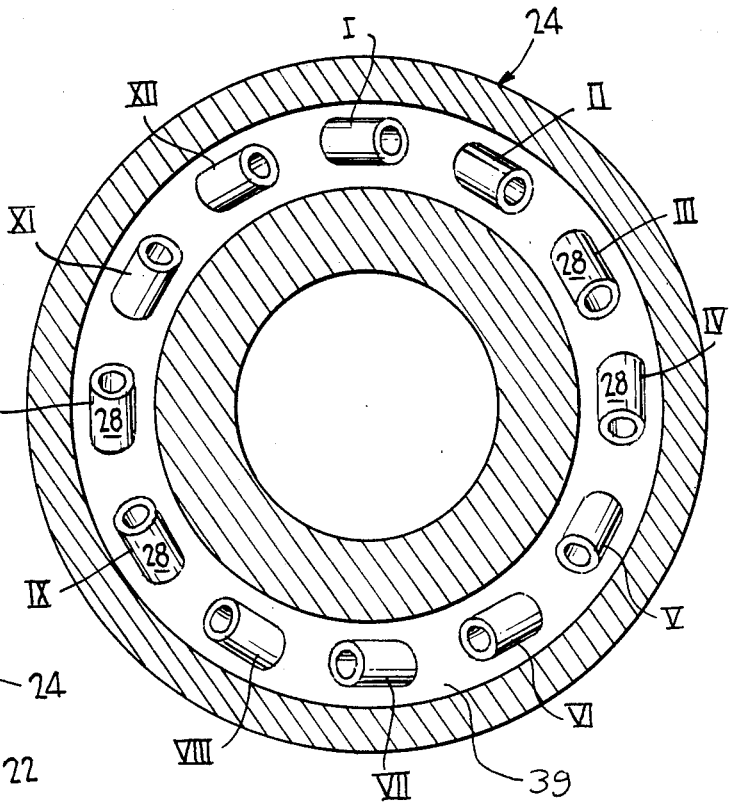
FIG. 5 is a cross sectional view taken along line V—V of FIG. 2 showing the collar in an embodiment of the invention utilizing one dozen guns.

FIGS. 2, 3 and 4 show in greater detail internal subsections of the alarm collar 2 including those hereinafter referred to as the "Gas Catcher Subsection" 22 and the "Detonation Telemetry Subsection" 24. FIG. 2 shows a vertical cross-section through the collar 2, which in the preferred embodiment is an elongated cylindrical member made of high strength carbon steel having a length of from four feet to sixty feet, for example, but could be any length practical for the intended use, central bore hole 15 extending therethrough to allow the mud to be pumped downwardly through the collar. Each end of the collar has appropriate connecting means, such as screw threads for connecting to the drill pipes of the drill string in a conventional manner, e.g., the upper end may have an internal thread 17 and the lower end may have an externally threaded projection 19. The diameter of bore hole 15 may conform with or be larger than the internal bore of the standard drill pipe of the drill string 1 with which the collar is used. The collar may have an outside diameter which is about five inches to about thirty inches and depends upon the size of the well hole and the drill bit which makes the well hole. FIG. 3 shows the detonation telemetry subsection 24 with a portion of the collar wall broken away. FIGS. 2 and 4 show how gas and well oil are trapped in the inverted cup portion 26 of the gas catcher. FIG. 5 shows a horizontal cross-section through the subsection 24 showing an array of one dozen gun barrels 28.

The operation of the alarm condition monitor system is initiated by the release of an unusual amount of a formation fluid such as gas, for example, (oils being somewhat less threatening and initiating a somewhat more subtle use of detectors), from a point in the well below the gas catcher subsection 22 at the lower end of the alarm collar 2 in FIG. 1.

In the absence of excess gas, as in normal drilling, the mud returning from the drill bit 4 up the annulus 38 between the drill string and bore hole wall, or casing, carries chips from the drill and largely dispersed oils and gases being freed from the formation below the bit by the crumbling of the formation structure. Under these conditions chips 34 of solid material are deflected outwardly into the formation side of the bore hole 3 by the combined action of centrifugal separation, gas catcher deflection shield 30 (FIG. 4) and the normal hydromechanics of the "slip" of lower density fluids such as mud and oil past the higher density drill chips 34.

The gas catcher consists of an elongated annular cavity 36 in the lower part of collar 2 and may have a length of from about two feet to about forty feet, or any suitable length for the intended purpose, and a difference between the inside and outside diameters of about one half to four inches, i.e. the width of the annulus.

The lower part of collar 2 has a tapered portion gradually reducing in size to that of the drill pipe at the lower end. Through this tapered portion extend screening slots 37 communicating with the lower end of annulus 36. The maximum width of screening slots 37 is smaller than the diameter of vent hole 40 to produce a screening effect thereby preventing plugging of vent hole 40 by chips which may enter through slots 37. Vent hole 40 is also tapered to assist outward flow therethrough of any such chips. A deflector 30 is provided just below the slotted portion 21 for deflecting chips radially outwardly away from slots 37. Deflector 30 has a substantially external conically-shaped surface and may be a collar attached at its internal diameter to the extension 19 above the screw thread thereon as shown in FIG. 7.

The gas catcher cavity 36 is thus normally "sampling", by the flow of fluids into the cavity through entry ports 37, the annulus fluids berift of larger solid chips.

A small flow exists through the gas catcher cavity 36 under such conditions controlled (in design) by the area of the bleed holes 40 at the top of the cavity and in operation by the pressure drop in the drilling annulus 38 over the length of the gas catcher cavity. With gas concentrations, in the normal range, being freed by the drill bit being dispersed in small bubbles within the mud, the gas catcher subsection 22 remains essentially full of this two phase mixture of macroscopically homogeneous material flowing upwardly through the cavity 36 at a velocity, v, of only a few inches or less/sec (as controlled by the bleed hole area 40) while the similar mixture in the annulus 38 outside may be flowing upwards at a velocity of many feet/second, V (See FIG. 2).

In the preferred embodiment a "Radcal" heat transfer monitor 42, hereinafter referred to as RHTM is mounted within the cavity 36 of FIG. 1, and produces an electrical signal whose voltage is inversely proportional to the heat transfer coefficient existing on its surface. The structure and operation of the monitor 42 is similar to the RHTM described in U.S. Pat. No. 4,418,035, incorporated herein by reference.

An RHTM can generally be described as a device shown more clearly in FIGS. 2 and 9, using multiple mineral insulated thermocouples, or difference thermocouples 48, in several cables 49 arranged coaxially around a mineral-insulated, stainless steel-jacketed, heater cable 50 having alternating hot and cold parts imbedded by swaging or drawing operations into a rigid metal rod 52. Heated segments 44, which may be electrical resistance units of the heater cable can be imbedded within and along the solid rod structure 52 for obtaining measurements along extended lengths of the rod. There may be up to sixteen sensor cables which may be clad in stainless steel, containing the thermocouples. The rod 52 which may be made of steel may have an outside diameter of from 3 mm to 12 mm, for example, and a length of several thousand feet with the capability of being sharply bent. The RHTM is a "bulletproof" sensor concept.

In the embodiment shown, particularly in FIGS. 2 and 10, resistance element 44 extends only in a region to heat or effect only one junction 47, the hot junction, but not effect the cold junction 45.

The RHTM 42 uses known heat flux at a position remote from one junction of a difference thermocouple (See FIG. 10) to measure heat transfer coefficient in accordance with the mathematical expression:

$$ho = \frac{(q/A) \text{ from } I^2R}{\Delta t \text{ (film) [which is } = \Delta t \text{ signal} - \Delta t \text{ metal]}}$$

wherein:

ho=surface heat transfer coefficient of the film on the outer surface of rod 52 (e.g., watts/cm$^2$—degrees C.);

q=heat flow per unit length per sec through the surface of rod 52 in watts/cm;

A=surface area of rod 52 per unit length in cm$^2$/cm;

q/A=heat flux in watts/cm$^2$ of rod surface;

$$\Delta t(\text{film}) = \Delta t(\text{signal}) - \Delta t(\text{metal});$$

Δt(Signal)=temperature difference of hot and cold junctions of the thermocouple 48 in degrees C.;

Δt(metal)=calculated temperature drop from center line of heater to surface of rod 52 in degrees C.;

I=current in resistor (heater) 44, in amperes;

R=resistance in ohms/cm of heater length 44;

MV=difference thermocouple signal of thermocouple 48 in millivolts. (For Type K—chromel-alumel thermocouple, 1 MV signal=approximately 250 degrees C. temperature difference between hot and cold junctions).

In FIG. 10, arrows represent heat from rod 52 to the ambient fluid and curve "q/A" represents either surface temperature profile or heat flux profile from the surface. It should be noted that there is no such heat flux at the surface adjacent the cold junction 45.

The absolute value of this RHTM signal is determined by the power supplied to the centrally located segmented heater 44, shown in FIG. 9 and the cutaway view of FIG. 2, which is normally in the range of 1 to 10 watts. Also normally the cavity 36 is filled with mud flowing therethrough. When larger quantities of gas enter the upflowing mud, either as non-dispersed large "belches" or an excessively high concentration of smaller bubbles, a separation occurs within the gas catcher sub cavity 36, with gas collecting above drill mud 46 as shown in FIGS. 2 and 4. Although such separated gas continues to exit the gas catcher through the restrictive bleed holes 40, such escape is so limited that the liquid surface is ultimately depressed below the level of the heated junction of the differential thermocouple 48 of the RHTM, and as a result a large signal is emitted by thermocouple 48 and received at the sequential triggering electronics device 56 imbedded within the alarm condition collar 24 (as seen in FIG. 2), to which the RHTM is connected through bore 54. It will be apparent to one skilled in the art, that the gas catcher cavity 36 being, in essence, a low velocity stilling or separation chamber, it will produce not only a separation of gas and liquid phases of fluids, previously mixed with each other, but will allow immiscible liquids of differing densities, e.g., hydrocarbons and drilling mud, time to separate in the absence of turbulence (with lower density fluids occupying upper parts of the cavity and forcing the level of higher density components lower down in the cavity) as low density fluids accumulate. If the signal of the RHTM is set by the heater thermal rate at a value, X, (approximating 100 microvolts) surrounded by fluid having the thermal properties characterizing the normal "homogeneous" mud/-gas/oil mixture returning from the drill bit, the signal strength from the RHTM will more than double when the surrounding mixture is replaced by liquid hydrocarbons and increase on the order of ten fold when the normal mixture is replaced by gas. Velocity of the material contained in the gas catcher, relative to the RHTM, is essentially zero, because the bleed rate is infinitesimal relative to the volume of the cavity. Although rotational velocity of the drill pipe could be substantial, both entry ports 37 into the gas catcher and viscous drag from the walls of the cavity act to assure that the mass of the contained fluid is rotating at the same speed, resulting in zero relative velocity transverse to the RHTM sensor.

The trigger point of the alarm telemetry triggering impulse firing may be set at say 1.5×, to trigger device 56 when either oil or gas subtends the cavity or to trigger on gas only at a value above, say 5×. Other sensors capable of discriminating thermal or physical properties of gas vs. oil, vs. mud mixtures can be installed within the gas catcher cavity and arranged in "either/or" (parallel) or in "and" (series) triggering arrangements as will be described in greater detail hereinafter. Among such devices are the "Radical" Free Hydrogen meter (U.S. Pat. No. 4,567.013), and a "Radical"-based-downhole sensor that detects combustibility of sensor-surrounding fluid temperature rise on the surface of a rod arising from catalytically enhanced oxidation of hydrocarbons.

Catalytically enhanced oxidation to raise the temperature of a sensor (usually a platinum wire) has been used in the labs for measuring hydrocarbons since early days and is used today up hole on mud logging and hydrocarbon logging operations. In the invention, as shown in FIG. 11, sensor rod 52 has therein thermocouple 48' having hot and cold junctions 47',45' respectively. Resistance heater 44' in this embodiment extends the full length of the thermocouple in order to heat both junctions 45', 47'. In addition, a sleeve of catalyst material 80, e.g. platinum (with or without oxidant) is positioned in the outer surface of rod 52A', but only in the vicinity of the hot junction 47', so that it does not effect cold junction 45'.

Down hole in the shelter of a gas catcher sub section, with the proper oxidant and catalyst 80 one may not need an extreme amount of additional heat to raise the temperature of the captured oil or gas bubble to the rapid oxidation level. In any event, the central heater 44' can apply up to 20 W/cm of heating an in RHTM (easily red glowing if in stagnant gas). The difference thermocouple 48' in this case reads zero at whatever temperature exists until an exothermic reaction takes place on the catalyst 80 which raises the temperature of the hot junction. At this point the "gas in hole" signal and alarm is initiated. By the selection of the catalyst and heat rate from heater 44', one can, to a degree, select hydrocarbon constituents which are intended to produce an alarm.

Upon receipt of the level of signal calling for triggering of an alarm impulse, produced by gun or guns 28, within impulse generator cavity 39 seen in FIGS. 2 and 3 and connected to the triggering device 56, the amplifier of the electronic triggering device 56 causes electric ignition of the appropriate selected explosive cartridge in a gun, or guns, 28. Gun, or guns, 28 may have a shaped charge such as shown at 70, 72, 74, for example. In the preferred embodiment, a hard elastic projectile 60 is accelerated in cavity 39 by gun 28 at an angle (FIG. 3) to the axis of the drill string to impact upon a hardened surface anvil 62, which may be an integral part of the collar, as shown in FIG. 3, or of the annular closure/impact ring 63 to cavity 39 as shown in FIG. 2.

The nature of mechanical impulse imparted to the drill collar structure by the projectile 60 is controlled not only through selection of materials of construction but also parameters such as powder charge, caliber, and barrel venting. Factors affecting such selection are attenuation of strain or deformation wave in steel pipe and avoidance of damage to the annular mud filter cake and geophysical structure of the well, resulting from shock to the surrounding area, and many other considerations. The angular trajectory depicted in FIG. 3, of the preferred embodiment, imparts both longitudinal and torsional strains into the drill pipe collar structure, the torsional component suffering smaller attenuation in the wave to the surface as described in U.S. Pat. Nos. 3,588,804; 4,283,779; 3,790,930; 3,813,656. By selecting the angular impact angle of a projectile, or electrically accelerated, or gas expansion, accelerated armatures, a characteristic "signature" of the waves can be induced which are transmitted through the drill pipe of the drill string and arrive at the strain gage receivers 10 up well (FIG. 1) in which a fixed amplitude and time relationship of axial and transverse waves is required to satisfy the "Yes-an-alarm-condition-does-exist" condition for the drill stem, or string, alarm condition detector system upwell. The particular angle could be in the range from 0 degrees to 90 degrees, but preferably 15 degrees to 75 degrees, with respect to the longitudinal axis of the drill string and collar, and would be selected to produce the optimum longitudinal and torsional deformation wave dependent on factors such as the materials of construction, size of the parts, anticipated attenuation, and depth of the well hole.

In some cases less than maximum drill string deformation may be produced in order to impart more energy to seismic wave and mud pressure pulse telemetry channels.

A central design tendency would be to impart an impulse of duration 10–100 microseconds transmitting a momentum of 5–40 slug-ft to the collar by impact and resulting in short duration impulse forces ranging from hundreds of thousands to millions of pounds, and rates of energy delivery ranging from thousands to tens of thousands of horse power. The total energy delivery however is kept substantially lower than the level required to produce macroscopic fracture or other damage of the tough steel collar structure. The energy of a recoiling, ricocheting projectile may be dissipated within a cage structure surrounding the gun barrel, as shown in the alternative embodiment at the left of FIG. 2 wherein gun barrel 28' has on the outer end thereof a cylindrical extension 76 having slots 78 therein. The outer end of the member 76 is positioned close enough to the anvil 62 to catch the projectile after it has impacted the anvil.

FIG. 5 illustrates a ring of twelve transmitter guns 28 sequentially fired by appropriate circuitry within the solid state triggering section 56 as unplanned well fluid intrusions recur at any time during the drill cycle (e.g. a 2 month period). In the preferred embodiment, momentum carrying projectiles are fired within annular impulse generator cavity 39 in a collar 2 which may be replaceable. Such projectiles could also be accelerated by compressed gas or spring means. Not illustrated are interlock and disarm circuits and devices that prevent actuation when pressure in the gas catcher subsection is below any preset value, say 200 psi and/or prevent more than one alarm impulse, per well fluid intrustion, by requiring, for example, that good heat transfer, once lost, be restored before the firing circuit is armed for the next gun in firing sequence.

Sequential firing of explosive or compressed gas cartridges imparting momentum to projectiles and in turn to the drill pipe is accomplished, after time-separated recurrences of gas intrusion (or other formation fluid), as signalled by a high voltage from the difference thermocouple(s) of the gas detection subsection.

Threshold signals for triggering, sequencing of guns, and setting of elapsed time or other "rearming" criteria can be accomplished by means known in the prior art and do not constitute a part of this invention. An example of such triggering and sequencing of detonations downwell is shown in U.S. Pat. No. 2,755,432.

FIG. 6 shows an embodiment of a composite projectile 64 that imparts, for example, three sharp impulses in rapid sequence to the target anvil affixed internal to the collar thus producing a wave form "signature" that augments discrimination of this signal from other "noises" by the various alarm-pulse-detector/discriminator devices upwell. In the composite projectile shown, crushable porous materials 66 such as sintered steel or metallic pellets have sufficient compressive strength to maintain space between segments 68, 70, 72 of the projectile during the explosive acceleration of the projectile but crush under the higher forces of deceleration producing a triple impulse "tattoo" as the three hardened components of the projectile successively impact on the anvil. The strain diagrams of FIGS. *7a–7d* show that, although the initial torsional and longitudinal drill collar strains are of approximate equal magnitude, and occur at the same time, the waves received up well are attenuated differing degrees and arrive at different times. Both characteristics can be demanded for alarm-actuating pulse signature "acceptance" by analog or digital gating techniques familiar to those skilled in such art.

FIG. 8 shows the logic of an hierarchal condition probability receiver system, of the type shown schematically in FIG. 1, in which two or more diverse receivers, tuned to block all signals but those representing signature waves from the alarm impulse generators downwell, can be used to first alert the operator, then confirm positively to the operator that an alarm impulse has been fired downwell. In the two circuits fully shown, i.e. alarm condition "likely" and "certain", the "likely" alarm is lit or sounded when the first such signature has been detected in any one of the three telemetry channels there being the drill string deformation detected by strain gauges (or accelerometers) 9, the seismic wave detector system 8, and the mud pressure pulse detector system 12. In a true alarm event the first received normally would be the drill pipe strain wave from the strain gauge receiver unit 18. The "certain" alarm, klaxon, or even automatic action, is actuated when all three channels have accepted and reported the occurrence of an alarm impulse signature. The "probable" circuits can be set for "two out of three", or "sonic first", or one of other logic algorithms and by electronic means obvious to one skilled in the art. The alarm system function, in total, is dependent upon functioning of only one of the available channels of telemetry, but the operator has the option of calling for any additional levels of assurance he may specify to initiate successively more costly corrective action escalating to the possible extreme action of firing blow out preventor rams that shear off the drill string and seal off the well casing.

Kicks are invariably initiated from the uncased region of the well, lying below the last casing set and above the working level of the bit, but this uncased distance from which formation gas or fluid can emerge can be several hundred or even thousands of feet. To provide maximum protection the driller may elect to install two or more rather widely separated alarm condition detection/telemetry collars into the drill string.

Where multiple hydrocarbon or kick sensors have been deployed, they can be arranged in various down hole logic patterns (series, parallel), or combinations thereof, to balance the possibility of false alarm against the risks of failure to respond with an alarm impulse. For example "shots" from both of two widely separated collars could be required to actuate automatic emergency action if and only if, they occurred within 30 seconds of each other. In another embodiment, inside the gas catcher subsection an alarm "shot" could be triggered, if and only if, both free hydrogen and RHTM sensors indicated presence of excess hydrocarbon.

Having disclosed the preferred embodiment of the invention, I wish it to be understood that I do not desired to be limited to the exact details of construction described above for obvious modifications can be made by a person skilled in the art within the scope of the invention as defined by the claims.

I claim:

1. An alarm system for detecting the occurrence of undesirable events in a well bore and communicating the occurrence to a remote area comprising:

a sensor means for sensing a change in ambient conditions of predetermined magnitude in a well bore;

an acoustic impulse generator means which functions independently of activities at the remote area for generating an acoustic impulse of a magnitude to enable unambiguous detection of said impulse at the remote area in response to detection by said sensor means of a change of predetermined magnitude in the ambient conditions;

means for supporting said sensor means and impulse generator means in the area being monitored and for conducting an acoustic impulse from said impulse generator means;

self-powered actuating means operatively connecting said sensor means with said impulse generator means for actuating said impulse generator means in response to said sensor means; and impulse detector means remote from said impulse generator means for detecting an acoustic impulse generated by said impulse generator means.

2. A detector as claimed in claim 1 wherein:

said sensor means comprises a heat transfer monitor.

3. A detector as claimed in claim 1 wherein:

said sensor means comprises a hydrogen detector.

4. A detector as claimed in claim 1 wherein:

said sensor means is for sensing downwell fluids in deep wells; and said means for supporting said sensor means and impulse generator means comprises a drill string.

5. A detector as claimed in claim 4 and further comprising:

a collar connected to said drill string at a position downwell with respect to the surface; and wherein said sensor means and impulse generator means are in said collar.

6. A detector as claimed in claim 5, and further comprising:

an impulse generator cavity in said collar; and wherein said impulse generator means is mounted in said impulse generator cavity and comprises means for producing a deformation wave in the drill string.

7. A detector as claimed in claim 1 wherein:

said sensor means comprises means for measuring thermal conductivity properties of ambient fluids which properties are responsive to concentration of undesirable fluids in excess of predetermined threshold concentration thereof.

8. A detector as claimed in claim 5 wherein:

said sensor means comprises means for measuring thermal conductivity properties of ambient fluids which properties are responsive to concentration of undesirable fluids in excess of predetermined threshold concentration thereof.

9. A detector as claimed in claim 1 wherein:

said sensor means comprises a hydrocarbon sensor means for sensing abnormal oxidation rate of downwell fluids.

10. A detector as claimed in claim 8 and further comprising:

a fluid sampling cavity in said collar having inlet and outlet means for downwell fluids comprised of mixtures of mud and oil and mixtures of mud, oil and gas, said fluid sampling cavity being adapted to allow separation of said components to produce variations in said thermal conductivity properties; and wherein said sensor means is mounted within said fluid sampling cavity in position to sense said variations.

11. A detector as claimed in claim 9 and further comprising:

a fluid sampling cavity in said collar having inlet and outlet means for downwell fluids comprised of mixtures of mud and oil and mixtures of mud, oil and gas, said cavity being adapted to allow separation of said components to produce variations in said oxidation rate; and wherein said hydrocarbon sensor means is mounted within said fluid sampling cavity in position to sense said variations.

12. A detector as claimed in claim 6 wherein:

said impulse generator means produces at least a deformation wave which travels in the longitudinal direction of the drill string; and said impulse detector means detects said longitudinal deformation wave.

13. A detector as claimed in claim 6 wherein:

said impulse generator means produces at least a torsional deformation wave in the drill string; and said impulse detector means detects said torsional deformation wave.

14. A detector as claimed in claim 12 wherein:

said impulse detector means comprises strain gauge means mounted on said drill string above said collar.

15. A detector as claimed in claim 13 wherein:

said impulse detector means comprises strain gauge means mounted on said drill string above said collar.

16. A detector as claimed in claim 5 and further comprising:

an impulse generator cavity in said collar; and wherein said impulse generator means comprises a projectile means in said impulse generator cavity, a projectile accelerating means in said impulse generator cavity, and means on the interior surface of said impulse generator cavity disposed to receive the impact of said projectile; and said impulse detector means detects said projectile impact through said drill string.

17. A detector as claimed in claim 16 wherein:

said collar is made of metal; and said impact receiving means comprises the interior surface of said impulse generator cavity.

18. A detector as claimed in claim 16 wherein:

said collar is made of metal; and said impact receiving means comprises a steel anvil mounted on the interior surface of said impulse generator cavity.

19. A detector for detecting the occurrence of undesirable events in a well bore and producing an alarm signal comprising:

a sensor means for sensing a change in ambient conditions of predetermined magnitude in a well bore;

an acoustic impulse generator means which functions independently of activities at an area remote from the detector for generating an acoustic impulse in response to detection by said sensor means of a change in the ambient conditions of predetermined magnitude;

means for supporting said sensor means and impulse generator means in a well bore and conducting an acoustic impulse produced by said impulse generator means; and self-powered actuating means operatively connecting said sensor means with said impulse generator means for actuating said impulse generator means in response to said sensor means.

20. A detector as claimed in claim 19 wherein:

said sensor means comprises a heat transfer monitor.

21. A detector as claimed in claim 19 wherein:

said sensor means comprises a hydrogen detector.

22. A detector as claimed in claim 19 wherein:

said sensor means is for sensing downwell fluids in deep wells;

said means for supporting said sensor means and impulse generator means comprises a cylindrical collar; and said sensor means and impulse generator means are in said collar.

23. A detector as claimed in claim 22, and further comprising:

an impulse generator cavity in said collar; and wherein said impulse generator means is mounted in said impulse generator cavity and comprises means for producing a deformation wave in said collar.

24. A detector as claimed in claim 22 wherein:

said sensor means comprises means for measuring thermal conductivity properties of ambient fluids which properties are responsive to concentration of undesirable fluids in excess of predetermined threshold concentration thereof.

25. A detector as claimed in claim 24 and further comprising:

a fluid sampling cavity in said collar having inlet and outlet means for downwell fluids in an oil well comprised of mixtures of mud and oil and mixtures of mud, oil and gas, said fluid sampling cavity beig adapted to allow separation of said components to produce variations in said thermal conductivity properties; and wherein said sensor means is mounted within said fluid sampling cavity in position to sense said variations.

26. A detector as claimed in claim 22 and further comprising:

an impulse generator cavity in said collar; and wherein said impulse generator means comprises a projectile means in said impulse generator cavity, a projectile accelerating means in said impulse generator cavity, and means on the interior surface of said impulse generator cavity disposed to receive the impact of said projectile.

27. A detector as claimed in claim 26 wherein:

said collar is made of metal.

28. A detector for use in wells comprising:

a drill string;

a collar connected to said drill string at a position downwell with respect to the surface;

a sensor means supported in said collar in the area being monitored for sensing downwell fluids in deep wells;

an impulse generator cavity in said collar;

an acoustic impulse generator means mounted in said impulse generator cavity for producing a deformation wave in said drill string having longitudinal torsional and radial components;

means operatively connecting said sensor means with said impulse generator means so that said impulse generator means is actuated in response to said sensor means;

impulse detector means remote from said impulse generator means for detecting an acoustic impulse from said impulse generator means comprising strain detector means mounted on said drill string above said collar for detecting and generating signals in response to said deformation waves, a pipe strain receiver, means operatively connected to said strain detector for transmitting said signals to said pipe strain receiver, and a pipe strain signature detector operatively connected to said pipe strain receiver for receiving signals therefrom;

means for sensing seismic waves produced by said deformation waves;

a seismic signature detector operatively connected to said seismic wave sensing means for receiving signals therefrom;

means for sensing mud pressure within said drill string produced by said deformation waves;

a mud pressure wave detector operatively connected to said mud pressure sensing means for receiving signals therefrom; and pulse analyzer means operatively connected to said pipe strain signature detector, seismic signature detector, and mud pressure wave detector for receiving signals therefrom and discriminating between and issuing an alarm for an alarm condition likely, alarm condition probable, and alarm condition certain.

29. A detector for use in wells comprising:

a drill string;

a collar connected to said drill string at a position downwell with respect to the surface, said collar being made of metal and having upper and lower portions;

an elongated fluid sampling cavity in said collar having lower and upper ends;

inlet means for downwell fluids comprised of mixtures of mud and oil and mixtures of mud, oil and gas comprising at least one opening extending through said collar into said lower end of said fluid sampling cavity;

outlet means for said downwell fluids comprising at least one opening extending from the upper end of said fluid sampling cavity through said collar;

sensor means mounted within said fluid sampling cavity comprising means for measuring thermal conductivity properties of said downwell fluids which properties are responsive to concentration of undesirable fluids in excess of a predetermined threshold concentration thereof; and said fluid sampling cavity being adapted to allow separation of the components of said mixtures to produce variations in said thermal conductivity properties;

said sensor means being mounted within said fluid sampling cavity in position to sense said variations; and said fluid sampling cavity being further adapted so that when gas enters into said cavity in abnormal amounts said gas occupies the position where said sensor is situated producing said variations in said thermal conductivity properies.

30. A detector for use in wells comprising:

a drill string;

a collar connected to said drill string at a position downwell with respect to the surface;

a sensor means supported in said collar in the area being monitored for sensing downwell fluids in deep wells;

an impulse generator cavity in said collar;

an acoustic impulse generator means mounted in said impulse generator cavity for producing at least a deformation wave which travels in the longitudinal direction of the drill string and a torsional deformation wave in the drill string;

impulse detector means remote from said impulse generator means for detecting said longitudinal and torsional deformation waves.

31. A detector as claimed in claim 30 wherein:

said impulse detector means comprises strain gauge means mounted on said drill string above said collar.

32. A detector as claimed in claim 31 wherein:

said strain gauge means is adapted to generate signals in response to said deformation waves; and further comprising transmitting means operatively connected to said strain gauge means for transmitting said signals to a pipe strain receiver therefor.

33. A detector as claimed in claim 32 wherein:

said transmitting means comprises a radio transmitter means.

34. A detector as claimed in claim 30 wherein:

said impulse detector means comprises accelerometer means mounted on said drill string above said collar for generating signals in response to said deformation waves; and further comprising means operatively connected to said accelerometer means for transmitting said signals to a pipe strain receiver therefor.

35. A detector for use in wells comprising:

a drill string;

a collar connected to said drill string at a position downwell with respect to the surface;

a sensor means in said collar in the area being monitored for sensing downwell fluids in deep wells;

an impulse generator cavity in said collar;

an acoustic impulse generator means comprising at least one gun having a gun barrel mounted in said impulse generator cavity;

a projectile means in said at least one gun barrel, means on the interior surface of said impulse generator cavity disposed to receive the impact of said projectile, an electrically fired explosive charge in said at least one gun barrel for accelerating said projectile means, and means for electrically connecting said sensor means to said explosive charge for firing said explosive charge to accelerate said projectile means; and impulse detector means remote from said impulse generator means for detecting said projectile impact through said drill string.

36. A detector as claimed in claim 35 wherein said electrical connecting means comprises:

electronic triggering means operatively connected to said sensor to be actuated by said sensor and operatively connected to said explosive charge to ignite said explosive charge when actuated by said sensor.

37. A detector as claimed in claim 35 wherein:

said collar is an elongated cylindrical member; and said gun barrel has a longitudinal axis extending at an angle to the longitudinal axis of said collar.

38. A detector as claimed in claim 36 wherein:

said impulse generator cavity is annular in shape;

said at least one gun comprises a plurality of guns arranged in circumferentially spaced relationship in said annular cavity; and said triggering means comprises a sequential triggering device for firing said guns in sequence.

39. A detector as claimed in claim 37 wherein:

said impulse generator is annular in shape;

said at least one gun comprises a plurality of guns arranged in circumferentially spaced relationship in said annular cavity; and said triggering means comprises a sequential triggering device for firing said guns in sequence.

40. A detector for use in wells comprising:

a drill string;

a collar connected to said drill string at a position downwell with respect to the surface;

a sensor means in said collar in the area being monitored for sensing downwell fluids in deep wells;

an impulse generator cavity in said collar;

an acoustic impulse generator means comprising at least one electrically fired shaped charge mounted in said impulse generator cavity, means for electrically connecting said shaped charge to said sensor means so that a signal from said sensor means fires said shaped charge, and means on the interior surface of said impulse generator cavity disposed to receive the force of said shaped charge and produce a deformation wave; and impulse detection means remote from said impulse generator means for detecting said deformation wave.

41. A detector for use in wells comprising:

a cylindrical metal collar having upper and lower portions;

an elongated fluid sampling cavity in said collar having lower and upper ends;

inlet means for downwell fluids comprised of mixtures of mud and oil and mixtures of mud, oil and gas comprising at least one opening extending through said collar into said lower end of said fluid sampling cavity;

outlet means for said downwell fluids comprising at least one opening extending from the upper end of said fluid sampling cavity through said collar;

sensor means mounted within said fluid sampling cavity comprising means for measuring thermal conductivity properties of said downwell fluids which properties are responsive to concentration of undesirable fluids in excess of a predetermined threshold concentration thereof;

said fluid sampling cavity being adapted to allow separation of the components of said mixture to produce variations in said thermal conductivity properties;

said sensor means being mounted within said fluid sampling cavity in position to sense said variations;

said fluid sampling cavity being further adapted so that when gas enters into said cavity in abnormal amounts said gas occupies the position where said sensor is situated producing said variations in said thermal conductivity properties;

an acoustic impulse generator means mounted in said collar; and means operatively connecting said sensor means with said impulse generator means so that said impulse generator means is actuated in response to said sensor means.

42. A detector for use in wells comprising:

a cylindrical collar having a longitudinal axis;

an impulse generator cavity in said collar;

an acoustic impulse generator means mounted in said impulse generator cavity for producing a deformation wave having components which travel at least in the longitudinal and torsional directions in said collar;

a sensor means supported in said collar for sensing downwell fluids in deep wells in the area in which said sensor is located; and means operatively connecting said sensor means with said impulse generator means so that said impulse generator means is actuated in response to said sensor means.

43. A detector for use in wells comprising:

a cylindrical collar;

an impulse generator cavity in said collar;

an acoustic impulse generator means comprising at least one gun having a gun barrel mounted in said impulse generator cavity, a projectile means in said at least one gun barrel, an electrically fired explosive charge in said at least one gun barrel for accelerating said projectile means, and means on the interior surface of said impulse generator cavity disposed to receive the impact of said proectile means and produce a deformation wave in said collar;

a sensor means supported in said collar for sensing downwell fluids in deep wells in the area in which said sensor is located; and means operatively connecting said sensor means with said impulse generator means so that said impulse generator means is actuated in response to said sensor means.

44. A detector as claimed in claim 43 wherein said electrical connecting means comprises:

electronic triggering means operatively connected to said sensor to be actuated by said sensor and operatively connected to said explosive charge to ignite said explosive charge when actuated by said sensor.

45. A detector as claimed in claim 43 wherein:

said collar is an elongated cylindrical member; and said gun barrel has a longitudinal axis extending at an angle to the longitudinal axis of said collar.

* * * * *